US006341919B1

(12) United States Patent
Simpson

(10) Patent No.: US 6,341,919 B1
(45) Date of Patent: Jan. 29, 2002

(54) THREADED SIDE BAR INSERTER

(75) Inventor: Vincent F. Simpson, Piedmont, OK (US)

(73) Assignee: Southpac Trust Int'l Inc.

( * ) Notice: Subject to any disclaimer, the term of this patent is extended or adjusted under 35 U.S.C. 154(b) by 2 days.

(21) Appl. No.: 09/589,447

(22) Filed: Jun. 7, 2000

(51) Int. Cl.[7] ..... E01C 23/04
(52) U.S. Cl. ..... 404/88; 404/100; 404/47
(58) Field of Search ..... 404/72, 73, 74, 404/87, 88, 100, 118, 83, 47, 51, 52

(56) References Cited

U.S. PATENT DOCUMENTS

| | | | | |
|---|---|---|---|---|
| 4,688,963 A | | 8/1987 | Ritchey et al. | 404/72 |
| 5,190,397 A | * | 3/1993 | Bengford et al. | 404/88 |
| 5,209,602 A | * | 5/1993 | Godbersen | 404/88 |
| 5,405,212 A | * | 4/1995 | Swisher, Jr. et al. | 404/74 |
| 5,993,108 A | * | 11/1999 | Buhman | 404/88 |
| 6,176,643 B1 | * | 1/2001 | Gunter, Jr. et al. | 404/88 |

FOREIGN PATENT DOCUMENTS

| | | | |
|---|---|---|---|
| EP | 0117323 | * | 2/1983 |

* cited by examiner

*Primary Examiner*—Thomas B. Will
*Assistant Examiner*—Alexander Pechhold
(74) *Attorney, Agent, or Firm*—Dunlap, Codding & Rogers

(57) ABSTRACT

An apparatus for inserting a side bar having a bar portion and a flanged end in a side face of a concrete slab formed by a slip form paver is provided. The apparatus includes a frame having a side bar receiving chamber defining a travel path. A slide pin is extendable through at least a portion of the side bar receiving chamber so as to engage the side bar and cause the side bar to be driven from the side bar receiving chamber along the travel path. A guide member is connected to the frame and movable between a first position wherein the guide member is positioned to vertically support the bar portion of the side bar in a selected relationship with respect to the side face of the concrete slab and a second position wherein the guide member is retracted from the travel path of the side bar to permit the flanged end of the side bar to travel past the guide member along the travel path unimpeded by the guide member.

33 Claims, 5 Drawing Sheets

THREADED SIDE BAR INSERTER

CROSS-REFERENCE TO RELATED APPLICATIONS

Not applicable.

BACKGROUND OF THE INVENTION

1. Field of the Invention.

The present invention relates generally to a side bar inserter, and more particularly, but not by way of limitation, to an apparatus for inserting a side bar having a bar portion and a flanged end in a side face of a concrete slab formed by a slip form paver.

2. Brief Description of the Related Art.

Roads and runways are constructed of large expanses of concrete pavement, and therefore, are generally comprised of several slabs of concrete formed adjacent one another. When forming one slab of concrete adjacent to another slab of concrete, the adjacent concrete slabs are typically tied together with a plurality of steel side bars (also known as tie bars) spanning between each of the adjacent slabs. The side bars are inserted into the side face of the initially formed concrete slab so that a portion of the side bars extend a distance from the side face of the concrete slab. The adjacent slab is then poured thereby encompassing the extended portion of the side bars.

When a slip form paver is used to form the concrete slab, the side bars are often inserted into the side face of the concrete slab as the concrete slab is being formed. Slip form pavers are self-propelled machines having spaced vertical side forms and a screed extending between the side forms. The screed is supported by a frame and screeds the concrete deposited on the road bed ahead of the advancing slip form paver. The pressure exerted on the concrete by the screed and the side forms is sufficient so that the contour of the concrete slab is maintained as the slip form paver continues to advance down the road bed.

Side bars have conventionally been straight metal rods having a length sufficient so that half the side bar extends into one concrete slab and the other half extends into the adjacent concrete slab. To this end, numerous devices have been proposed for use in conjunction with a slip form paver for inserting such side bars into the side face of a concrete slab.

However, a two piece side bar has been introduced in recent years. The two piece side bar includes a first section that is inserted into the initially formed concrete slab and a second section that is connected to the first section so as to extend from the initially formed concreted slab prior to forming the adjacent concrete slab. The first section has an open threaded end which is adapted to threadingly receive one end of the second section. The threaded open end of the first section is also provided with an outwardly extending flange which acts to limit the depth of insertion of the first section into the concrete slab to where the threaded opening is substantially flush with the side face of the concrete slab.

When employing the side bar inserters of the prior art to insert the first section, problems are encountered due to the existence of the flange of the first section. That is, the side bar inserters of the prior art are provided with a bar receiving chamber in which a straight side bar will lie flat and in turn be inserted into the concrete slab in a normal relation relative to the side face of the concrete slab. However, when the first section of the two piece side bar is placed in the bar receiving chamber, the flange causes the bar portion to lie at an angle with respect to the side face of the concrete slab. As a result, the first section will be inserted into the concrete slab at a downward angle which will result in the second section extending at an upward angle.

To this end, an apparatus is needed for inserting a side bar having a bar portion and a flanged end in a side face of a concrete slab formed by a slip form paver which will accommodate the flanged end and thus permit the bar portion to be disposed at a selected relationship relative to the side face of the concrete slab. It is to such an apparatus that the present invention is directed.

BRIEF SUMMARY OF THE INVENTION

The present invention is directed to an apparatus for inserting a side bar having a bar portion and a flanged end in a side face of a concrete slab formed by a slip form paver. The apparatus includes a frame having a side bar receiving chamber defining a travel path. A slide pin is extendable through at least a portion of the side bar receiving chamber so as to engage the side bar and cause the side bar to be driven from the side bar receiving chamber along the travel path. A guide member is connected to the frame and movable between a first position wherein the guide member is positioned to vertically support the bar portion of the side bar in a selected relationship with respect to the side face of the concrete slab and a second position wherein the guide member is retracted from the travel path of the side bar to permit the flanged end of the side bar to travel past the guide member along the travel path unimpeded by the guide member.

The features and advantages of the present invention will become apparent from the following detailed description when read in conjunction with the accompanying drawings and appended claims.

BRIEF DESCRIPTION OF THE SEVERAL VIEWS OF THE DRAWING

FIGS. 6A–6C are side elevational views of the side bar inserter of the present invention illustrating the sequential operation of the side bar inserter during the process of inserting a threaded side bar into the side face of a concrete slab.

DETAILED DESCRIPTION OF THE INVENTION

Figure 1:
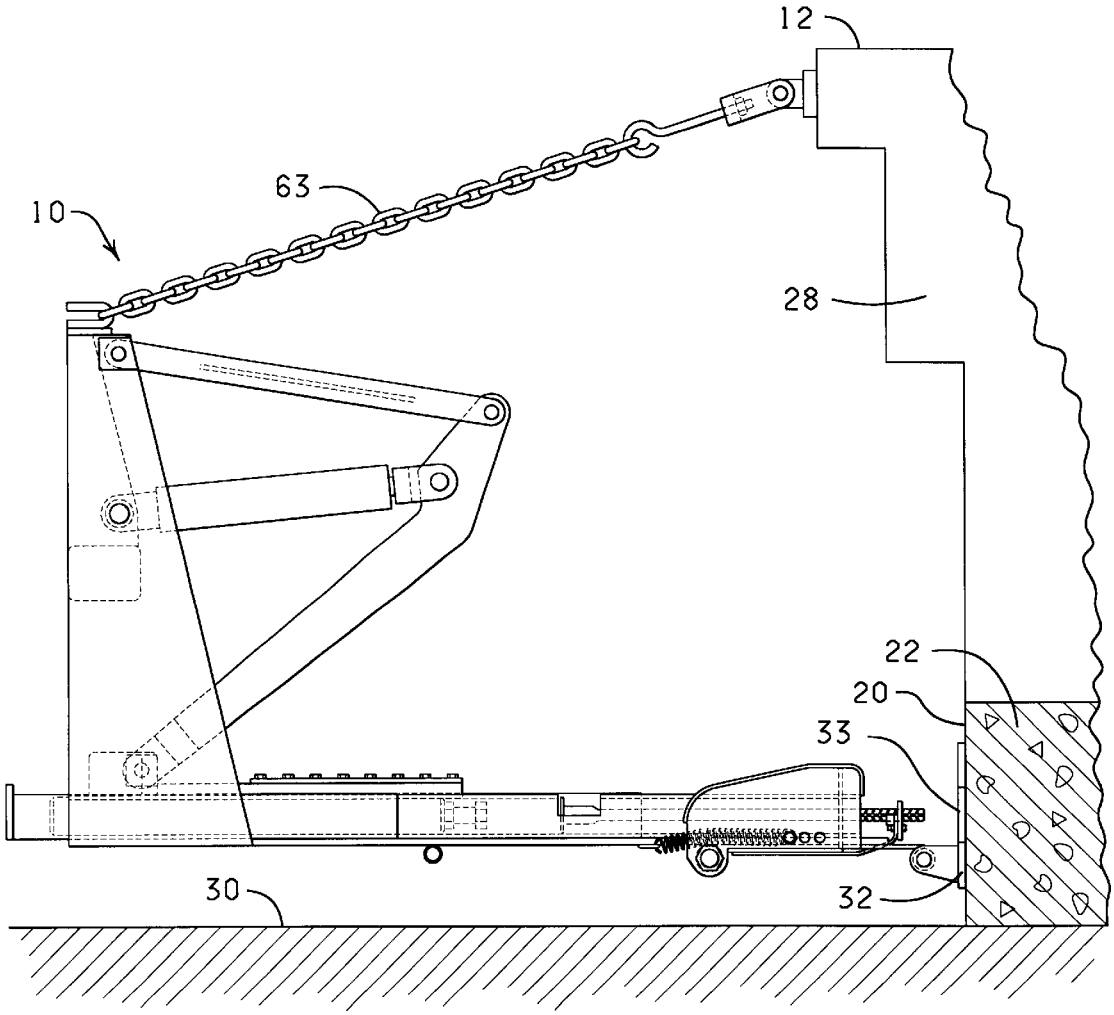
FIG. 1 is a side elevational view of a side bar inserter constructed in accordance with the present invention shown mounted on a slip form paver.
Figure 2:
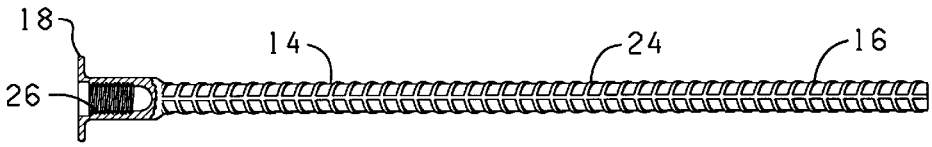
FIG. 2 is a partially cutaway, side elevational view of a first section of a threaded side bar.

Referring now to the drawings, and more particularly to FIGS. 1 and 2, a threaded side bar inserter 10 (FIG. 1) constructed in accordance with the present invention is shown mounted on the side of a slip form paver 12. The threaded side bar inserter 10 is used to insert a side bar 14 (FIG. 2) having a bar portion 16 and a flanged end 18 in a side face 20 of a concrete slab 22 formed by the slip form paver 12. More specifically, the side bar 14 is a first section 24 of a two piece side bar.

As mentioned above, a two piece side bar has been introduced in recent years. The two piece side bar includes the first section 24 that is inserted into the side face 20 of the concrete slab 22 and a second section (not shown) that is connected to the first section 24 so as to extend from the concrete slab 22 prior to forming an adjacent concrete slab. As illustrated in FIG. 2, the first section 24 includes the bar portion 16 and the flanged end 18. The first section 24 further has a threaded opening 26 which is adapted to threadingly receive one end of the second section (not shown). The flanged end 18 acts to limit the depth of insertion of the first section 24 into the concrete slab 22 to where the threaded opening 26 is substantially flush with the side face 20 of the concrete slab 22.

Returning to FIG. 1, the slip form paver 12 is a self-propelled machine having spaced vertical side forms (not shown) and a screed (also not shown) extending between the side forms. The screed is supported by a frame 28 and screeds concrete deposited on a road bed 30 ahead of the advancing slip form paver 12. The pressure exerted on the concrete by the screed and the side forms is sufficient so that the contour of the concrete slab 22 is maintained as the slip form paver 12 continues to advance down the road bed 30. The slip form paver 12 also include an edger 32 which travels along the side face 20 of the concrete slab 22. The edger 32 has a slot 33 which extends from the rear edge of the edger 32 towards the forward edge of the edger 32. The slot 33 provides an opening through which the side bar 14 is inserted into the side face 20 of the concrete slab 22 as the slip form paver 12 advances down the road bed 30.

Figure 3:
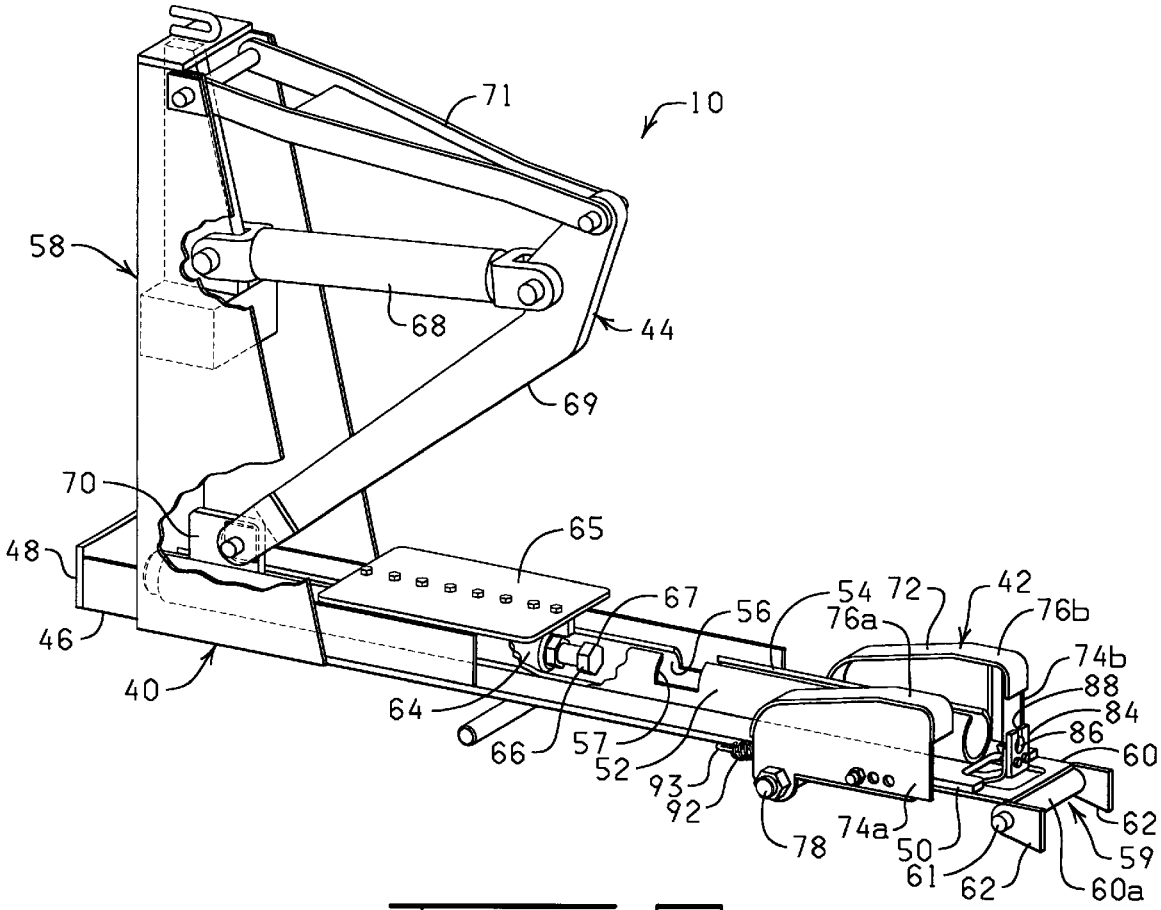
FIG. 3 is a perspective view of the side bar inserter of the present invention.

Referring now to FIG. 3, the threaded side bar inserter 10 includes a frame assembly 40, a bar guide assembly 42, and a slide pin assembly 44. The frame assembly 40 includes an elongated tray 46 having a first end 48, a second end 50. A guide tube 52 having a longitudinal slot 54 is secured in the tray 46 so as to define a side bar receiving chamber 56 which defines a travel path for the side bar 14. The slot 54 is dimensioned to permit the side bar 14 to be loaded into the side bar receiving chamber 56 through the slot 54. The slot 54 is provided with an enlarged section 57 for receiving the flanged end 18 of the side bar 14. The frame assembly 40 further includes an upright bracket assembly 58 extending from the near the first end 48 of the tray 46. The bracket assembly 58 supports the slide pin assembly 44.

Figure 4:
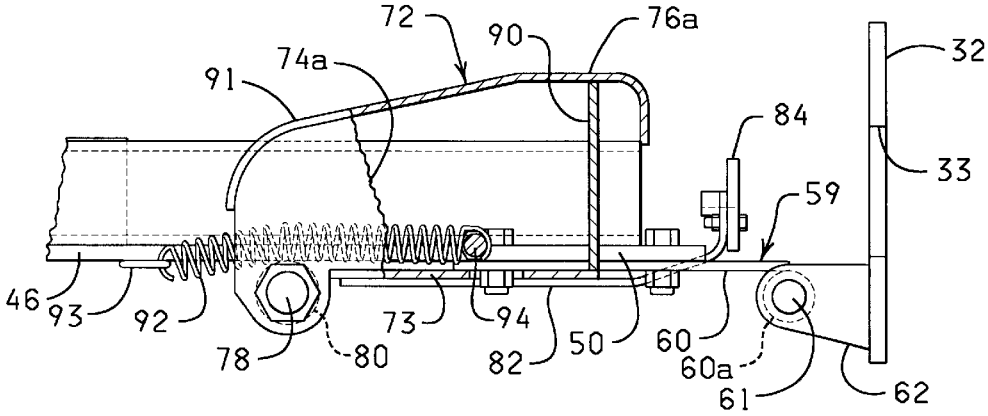
FIG. 4 is a partial cutaway, side elevational view of the guide flap assembly of the side bar inserter.

To connect the threaded side bar inserter 10 to the slip form paver 12, the second end 50 of the tray 46 is pivotally connected to the edger 32 of the slip form paver 12 by a tray hinge 59. The tray hinge 59 includes a first hinge member 60 attached to the bottom of the tray 46 (as best shown in FIG. 4), a pin 61 rotatably positioned within a tubular portion 60*a* of the first hinge member 60, and a pair of brackets or lugs 62 which are rotatably disposed on the pin 61 and attachable to the edger 32 by welding or the like. The upright bracket assembly 58 is suspended from the slip form paver 12 with a chain assembly 63 extendible between the upper end of the upright bracket assembly 58 and a portion of the slip form paver 12.

It will be appreciated by those of ordinary skill in the art that the threaded side bar inserter 10 can be attached to the slip form paver 12 in a variety of different ways other than that described above. For example, in addition to using the chain assembly 63 to support the upright bracket assembly 58, the pin 78 may be extended and utilized to attach the threaded side bar inserter 10 to an adjustable boom assembly (not shown) connected to and extending from the slip form paver 12 whereby the threaded side bar inserter 10 is not attached directly to the edger 32.

The slide pin assembly 44 includes a slide pin 64 and a guide flap depressor 65. The slide pin 64 is disposed in the side bar receiving chamber 56 so as to be movable through the side bar receiving chamber 56 between a retracted position (FIG. 3) and an extended position (FIG. 6C). The slide pin 64 has an engaging end 66 which is engageable with the flanged end 18 of the side bar 14 to cause the side bar 14 to be driven from the side bar receiving chamber 56 along the travel path defined by the side bar receiving chamber 56. The engaging end 66 of the slide pin 64 includes a bolt 67 which is adjustable along the longitudinal axis of the slide pin 64 to adjust the depth of insertion of the side bar 14 into the concrete slab 22.

The guide flap depressor 65 is a plate mounted to the slide pin 64 so that the guide flap depressor 65 travels in conjunction with the slide pin 64. The function of the guide flap depressor 65 will be described in detail below.

The slide pin assembly 44 further includes a cylinder 68 for moving the slide pin 64 through the side bar receiving chamber 56 between the retracted position and the extended position. The cylinder 68 has one end pivotally attached to the bracket assembly 58 and another end pivotally attached to a portion a rocker arm 69. The rocker arm 69 in turn has one end pivotally attached to a bracket 70 which is connected to the slide pin 64 and another end pivotally attached to one end of a link arm 71. The other end of the link arm 71 is pivotally attached to the bracket assembly 58. Upon extension of the cylinder 68 the slide pin 64 is caused to travel through the side bar receiving chamber 56 to the extended position and upon retraction of the cylinder 68 the slide pin 64 is caused to travel back through the side bar receiving chamber 56 to the retracted position. The cylinder 68 is preferably a hydraulic cylinder but it will be appreciated by those of ordinary skill in the art that other types of actuation, including pneumatic and electrical, as well as manual, can be employed.

It is desirable to insert the bar portion 16 of the side bar 14 into the side face 20 of the concrete slab 22 so that the bar portion 16 of the side bar 14 is in a substantially normal relationship to the side face 20 of the concrete slab 22 or some other selected relationship. Therefore, the bar guide assembly 42 is provided to compensate for the dimensional differences between the bar portion 16 and the flanged end 18 of the side bar 14, and thus, support the bar portion 16 of the side bar 14 in a selected relationship relative to the side face 20 of the concrete slab 22. At the same time, the bar guide assembly 42 is retractable so that the flanged end 18 of the side bar 14 may pass through the side bar receiving chamber 56 unimpeded by the bar guide assembly 42.

Figure 5:
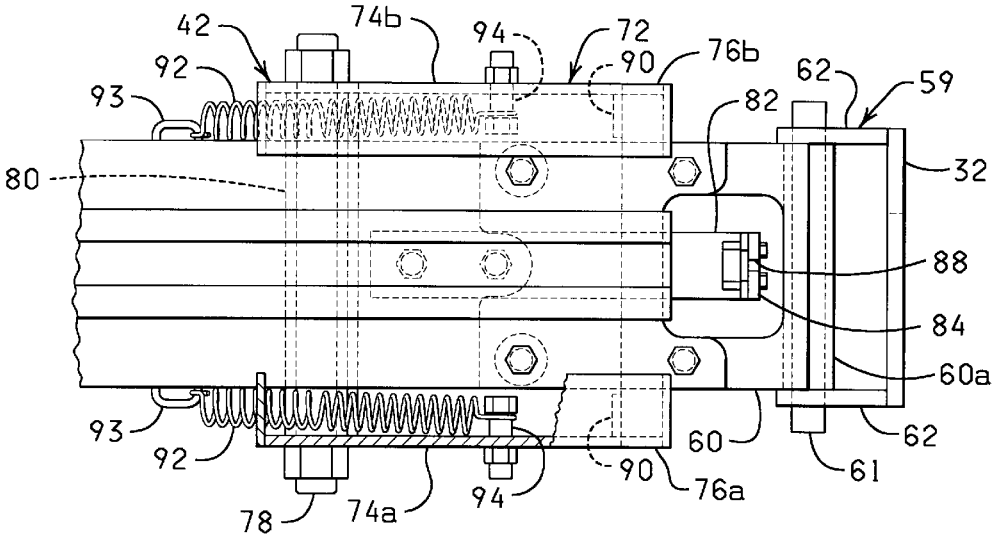
FIG. 5 is a partial cutaway, top plan view of the guide flap assembly of the side bar inserter.

As best shown in FIGS. 3–5, the bar guide assembly 42 comprises a guide flap 72 which has a bottom plate 73, a pair of upright plates 74*a*, 74*b* extending from opposites sides of the bottom plate 73, and a pair of slide plates 76*a*, 76*b* mounted on the upper end of the upright plates 74*a* and 74*b*, respectively. Each of the upright plates 74*a*, 74*b* is configured to receive and be secured to a pin 78 extending transversely between the upright plates 74*a* and 74*b*. The pin 78 is disposed through a tube 80 (illustrated in phantom in FIG. 5) which is attached to a lower surface of the tray 46 such that the guide flap 72 is rotatable relative to the tray 46 of the frame assembly 40.

The bar guide assembly 42 further includes a guide member bracket 82 mounted to the bottom plate 73 of the guide flap 72 and a guide member 84 mounted to the guide member bracket 82. The guide member 84 is provided with an opening 86 (FIG. 3) sized to slidingly support and guide the bar portion 16 of the side bar 14 and a slit 88 (FIGS. 3 and 5) to permit the guide member 84 to be selectively retracted or pulled away from the bar portion 16 of the side bar 14 in a manner to be discussed in greater detail below. As such, the guide member 84 is constructed of a pliable material, such as a rubber, that will permit the bar portion 16 of the side bar 14 to pass through the slit 88 upon the guide member 84 being retracted form the side bar 14. Alternatively, the end of the guide member bracket 82 can be configured to have a substantially U-shaped slot sized to slidingly support the bar portion 16 of the side bar 14 if the bar portion 16 of the side bar 14 does not require an loop type guide.

The slide plates 76*a* and 76*b* are spaced apart a suitable distance to permit the bar portion 16 of the side bar 14 to be disposed into the side bar receiving chamber 56. The slide plates 76*a* and 76*b* are further supported by a vertical brace 90. Each of the slide plates 76*a* and 76*b* has an angled surface 91 (FIG. 4) which is engageable by the leading edge of the guide flap depressor 65 so as to cause the guide flap 72 to move from a first position (FIG. 4) wherein the guide member 84 is positioned to support the bar portion 16 of the side bar 14 in a selected relationship with respect to the side face 20 of the concrete slab 22 and a second position (FIG. 6C) wherein the guide member 84 is retracted from the travel path of the side bar 14 to permit the flanged end 18 of the side bar 14 to travel past the guide member 84 along the travel path unimpeded by the guide member 84 upon at least a portion of the bar portion 16 of the side bar 14 being inserted into the side face 20 of the concrete slab 22 such that the bar portion 16 is vertically supported by the concrete slab 22.

The guide flap 72 is biased in the first position by a pair of extension springs 92. Each of the extension springs 92 has one end attached to a loop 93 formed on the tray 46 and another end attached to a bolt 94 extending from the upright plate 74*a* and 74*b*. The extension springs 92 extend over the tube 80, as best shown in FIG. 4, so as to cause the guide flap 72 to be biased in the first position wherein the bottom plate 73 of the guide flap 72 engages the bottom of the tray 46.

Operation

Figure 6A:
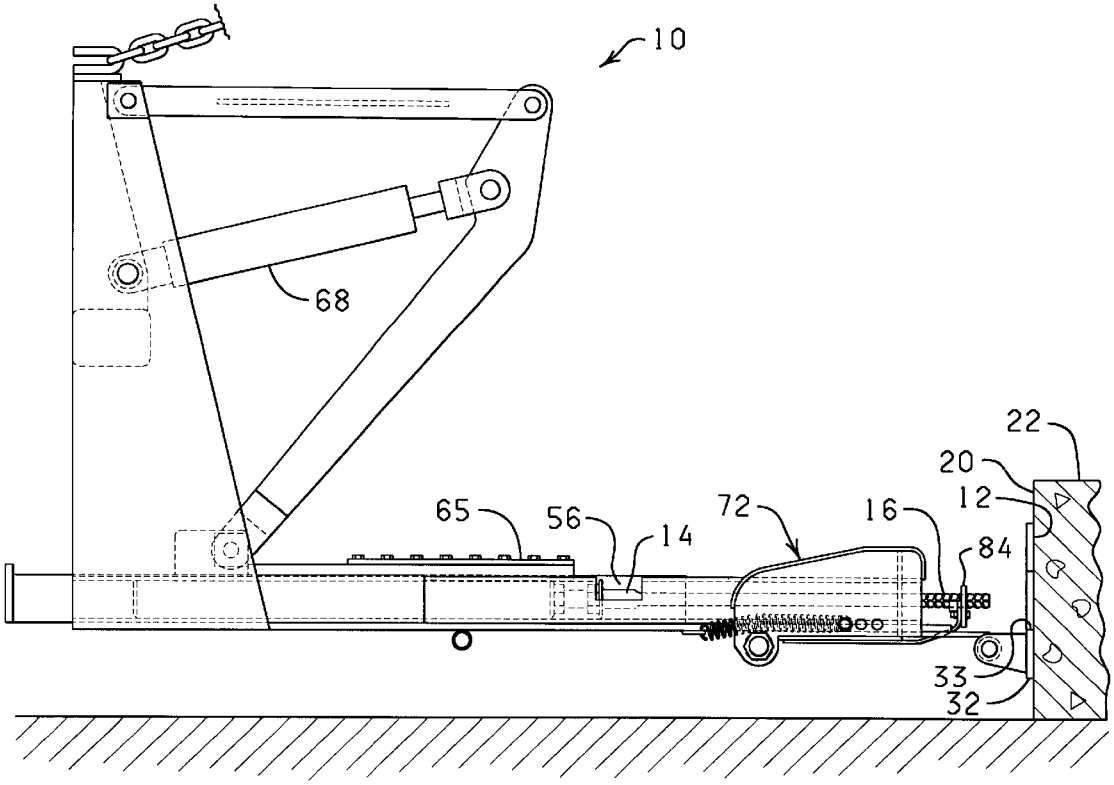
Figure 5B:
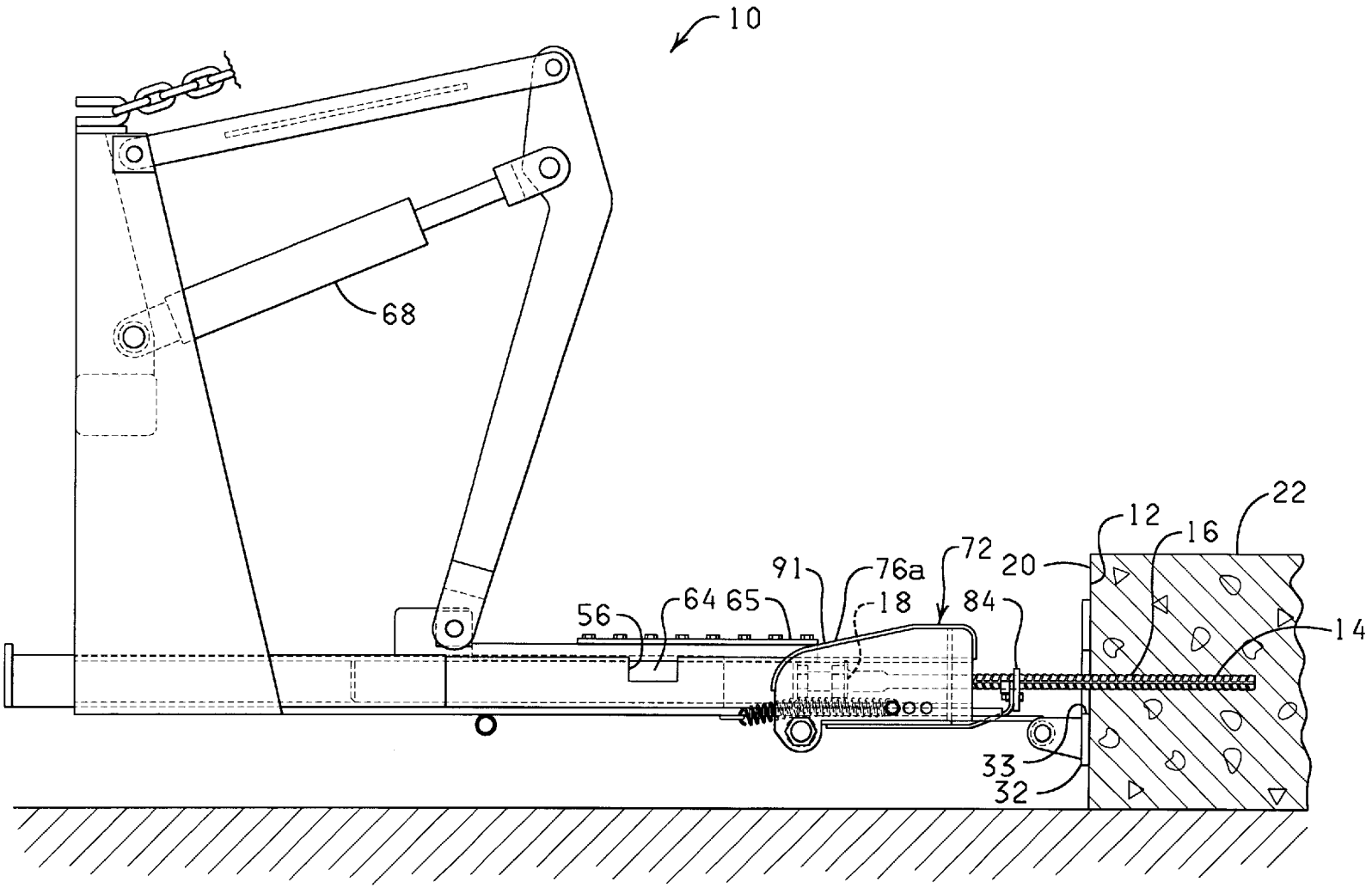
Figure 5C:
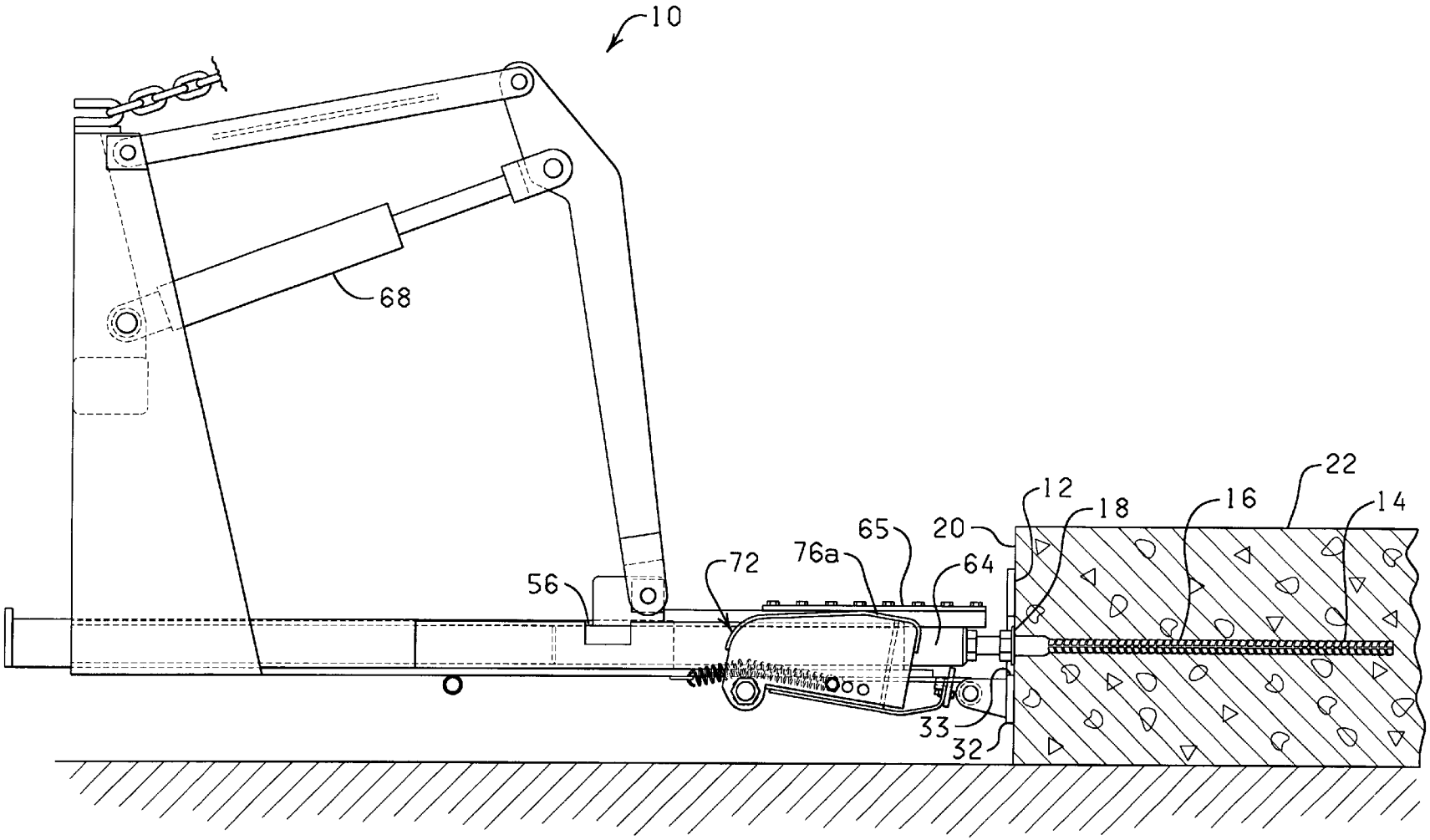

Referring now to FIGS. 6A–6C, the threaded side bar inserter 10 is attached to the slip form paver 12 so that the side bar receiving chamber 56 is aligned with the slot 33 of the edger 32 of the slip form paver 12 and positioned in a substantially normal relationship with respect to the edger 32. A side bar, such as the side bar 14 described above, is loaded into the side bar receiving chamber 56 with the bar portion 16 supported by the guide member 84 of the guide flap 72. The side bar 14 is manually loaded into the side bar receiving chamber 56. However, it will be appreciated that it may be possible to automatically feed the side bar 14 from a magazine (not shown).

With the side bar 14 in the side bar receiving chamber 56, the cylinder 68 is actuated so as to cause the cylinder 68 to move to the extended position thereby causing the slide pin 64 to move through the side bar receiving chamber 56 from the retracted position (FIG. 6A) to the extended position (FIG. 6C) so as to engage the flanged end 18 of the side bar 14 and cause the side bar 14 to be driven from the side bar receiving chamber 56 and into the side face 20 of the concrete slab 22. As the slide pin 64 travels through the side bar receiving chamber 56 from the retracted position to the extended position, the guide flap 72 is caused to be moved from the first position (FIGS. 6A and 6B) wherein the guide member 84 supports the bar portion 16 of the side bar 14 in a substantially normal relationship with respect to the side face 20 of the concrete slab 22 when the flanged end 18 of the side bar 14 is positioned in the side bar receiving chamber 56 to the second position (FIG. 6C) wherein the guide member 84 is retracted from the travel path of the side bar 14 to permit the flanged end 18 of the side bar 14 to travel past the guide member 84 along the travel path unimpeded by the guide member 84.

The guide flap 72 is caused to be rotated to the second position by the engagement of the guide flap depressor 65 with the slide plates 76*a* and 76*b* of the guide flap 72. As shown in FIG. 6B, the guide flap depressor 65 initially engages the slide plates 76*a* and 76*b* only upon at least a portion of the bar portion 16 of the side bar 14 being inserted into the side face 20 of the concrete slab 22 such that the bar portion 16 is vertically supported by the concrete slab 22. As the slide pin 64 continues to move to the extended position, the guide flap depressor 65 slidingly engages the angled surfaces 91 of the slide plates 76*a* and 76*b* causing the guide flap 72 and thus the guide member 84 to be rotated downwardly to the second position (FIG. 6C). With the guide member 84 retracted from the travel path of the side bar 14, the side bar 14 is driven into the side face 20 of the concrete slab 22 unimpeded by the guide member 84.

Subsequent to the side bar 14 being driven into the concrete slab 22, the cylinder 68 is actuated so as to cause the cylinder 68 to move to the retracted position thereby causing the slide pin 64 to move through the side bar receiving chamber 56 from the extended to the retracted position and thus disengaging the guide flap depressor 65 from the slide plates 76*a* and 76*b* of the guide flap 72 such that the guide flap 72 is caused to return to the first position ready to receive another side bar.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An apparatus for inserting a side bar having a bar portion and a flanged end in a side face of a concrete slab formed by a slip form paver, the apparatus comprising:

a frame having a side bar receiving chamber defining a travel path;

a slide pin extendable through at least a portion of the side bar receiving chamber so as to be engageable with a flanged end of a side bar positioned in the side bar receiving chamber of the frame and cause the side bar to be driven from the side bar receiving chamber along the travel path; and a guide member connected to the frame and movable between a first position wherein the guide member is positioned to vertically support a bar portion of the side bar positioned in the side bar receiving chamber in a selected relationship with respect to a side face of a concrete slab and a second position wherein the guide member is retracted from the travel path of the side bar to permit the flanged end of the side bar to travel past the guide member along the travel path unimpeded by the guide member.

2. The apparatus of claim 1 wherein the guide member has a an opening sized to receive the bar portion of the side bar and a slit extending between the opening and an exterior edge of the guide member.

3. The apparatus of claim 2 wherein the guide member is fabricated of pliable material.

4. The apparatus of claim 1 wherein the guide member is biased in the first position.

5. The apparatus of claim 1 wherein the guide member is caused to be moved to the second position subsequent to at least a portion of the bar portion of the side bar being inserted into the side face of the concrete slab such that the bar portion is vertically supported by the concrete slab.

6. The apparatus of claim 1 wherein the frame is attachable to the slip form paver.

7. An apparatus for inserting a side bar having a bar portion and a flanged end in a side face of a concrete slab formed by a slip form paver, the apparatus comprising:

a frame having a side bar receiving chamber defining a travel path;

a slide pin movable through the side bar receiving chamber between a retracted position and an extended position so as to be engageable with a flanged end of a side bar positioned in the side bar receiving chamber of the frame and cause the side bar to be driven from the side bar receiving chamber along the travel path;

a guide flap pivotally connected to the frame and having a guide member extending therefrom, the guide flap movable from a first position wherein the guide member is positioned to support a bar portion of the side bar positioned in the side bar receiving chamber in a selected relationship with respect to a side face of a concrete slab and a second position wherein the guide member is retracted from the travel path of the side bar to permit the flanged end of the side bar to travel past the guide member along the travel path unimpeded by the guide member; and a guide flap depressor connected to the slide pin and engageable with the guide flap to cause the guide flap to move from the first position to the second position as the slide pin travels through the side bar receiving chamber between the retracted position and the extended position.

8. The apparatus of claim 7 wherein the guide flap depressor engages the guide flap so as to move the guide flap from the first position to the second position subsequent to at least a portion of the bar portion of the side bar being inserted into the side face of the concrete slab such that the bar portion is vertically supported by the concrete slab.

9. The apparatus of claim 8 wherein the guide flap includes a pair of spaced apart angled surfaces positioned for sliding engagement with the guide flap depressor such that the guide flap depressor causes the guide flap to be deflected to the second position as the slide pin travels through the side bar receiving chamber between the retracted position and the extended position.

10. The apparatus of claim 7 wherein the guide member has a an opening sized to receive the bar portion of the side bar and a slit extending between the opening and an exterior edge of the guide member.

11. The apparatus of claim 10 wherein the guide member is fabricated of pliable material.

12. The apparatus of claim 7 further comprising a cylinder connected to the slide pin for moving the slide pin between the retracted position and the extended position.

13. The apparatus of claim 12 wherein the cylinder is hydraulically operated.

14. The apparatus of claim 7 wherein the guide flap is biased in the first position.

15. The apparatus of claim 7 wherein the guide member is caused to be moved to the second position subsequent to at least a portion of the bar portion of the side bar being inserted into the side face of the concrete slab such that the bar portion is vertically supported by the concrete slab.

16. The apparatus of claim 7 wherein the frame is attachable to the slip form paver.

17. An apparatus in combination with a slip form paver for inserting a side bar having a bar portion and a flanged end in a side face of a concrete slab formed by the slip form paver, the apparatus comprising:

a frame attached to the slip form paver and having a side bar receiving chamber defining a travel path;

a slide pin extendable through at least a portion of the side bar receiving chamber so as to engage the flanged end of the side bar and cause the side bar to be driven from the side bar receiving chamber along the travel path;

a guide member connected to the frame and movable between a first position wherein the guide member is positioned to vertically support the bar portion of the side bar in a selected relationship with respect to the side face of the concrete slab and a second position wherein the guide member is retracted from the travel path of the side bar to permit the flanged end of the side bar to travel past the guide member along the travel path unimpeded by the guide member.

18. The apparatus of claim 17 wherein the guide member has a an opening sized to receive the bar portion of the side bar and a slit extending between the opening and an exterior edge of the guide member.

19. The apparatus of claim 18 wherein the guide member is fabricated of pliable material.

20. The apparatus of claim 17 wherein the guide member is biased in the first position.

21. The apparatus of claim 17 wherein the guide member is caused to be moved to the second position subsequent to at least a portion of the bar portion of the side bar being inserted into the side face of the concrete slab such that the bar portion is vertically supported by the concrete slab.

22. An apparatus in combination with a slip form paver for inserting a side bar having a bar portion and a flanged end in a side face of a concrete slab formed by the slip form paver, the apparatus comprising:

a frame attached to the slip from paver and having a side bar receiving chamber defining a travel path;

a slide pin movable through the side bar receiving chamber between a retracted position and an extended position so as to engage the side bar and cause the side bar to be driven from the side bar receiving chamber along the travel path;

a guide flap pivotally connected to the frame and having a guide member extending therefrom, the guide flap movable from a first position wherein the guide member is positioned to support the bar portion of the side bar in a selected relationship with respect to the side face of the concrete slab and a second position wherein the guide member is retracted from the travel path of the side bar to permit the flanged end of the side bar to travel past the guide member along the travel path unimpeded by the guide member; and a guide flap depressor connected to the slide pin and engageable with the guide flap to cause the guide flap to move from the first position to the second position as the slide pin travels through the side bar receiving chamber between the retracted position and the extended position.

23. The apparatus of claim 22 wherein the guide flap depressor engages the guide flap so as to move the guide flap from the first position to the second position subsequent to at least a portion of the bar portion of the side bar being inserted into the side face of the concrete slab such that the bar portion is vertically supported by the concrete slab.

24. The apparatus of claim 23 wherein the guide flap includes a pair of spaced apart angled surfaces positioned for sliding engagement with the guide flap depressor such that the guide flap depressor causes the guide flap to be deflected to the second position as the slide pin travels through the side bar receiving chamber between the retracted position and the extended position.

25. The apparatus of claim 22 wherein the guide member has a an opening sized to receive the bar portion of the side bar and a slit extending between the opening and an exterior edge of the guide member.

26. The apparatus of claim 24 wherein the guide member is fabricated of pliable material.

27. The apparatus of claim 22 further comprising a cylinder connected to the slide pin for moving the slide pin between the retracted position and the extended position.

28. The apparatus of claim 27 wherein the cylinder is hydraulically operated.

29. The apparatus of claim 22 wherein the guide flap is biased in the first position.

30. The apparatus of claim 22 wherein the guide member is caused to be moved to the second position subsequent to at least a portion of the bar portion of the side bar being inserted into the side face of the concrete slab such that the bar portion is vertically supported by the concrete slab.

31. A method of inserting a side bar having a bar portion and a flanged end in a side face of a concrete slab formed by a slip form paver, comprising:

providing a frame having a side bar receiving chamber defining a travel path;

positioning the side bar in the side bar receiving chamber with the bar portion of the side bar positioned on a guide member which vertically supports the: side bar in a selected relationship relative to the side face of the concrete slab;

driving the side bar from the side bar receiving chamber and into the side face of the concrete slab along the travel path; and retracting the guide member from the travel path of the side bar thereby enabling the flanged end of the side bar to permit the flanged end of the side bar to travel past the guide member along the travel path unimpeded by the guide member.

32. The method of claim 31 wherein the guide member is retracted from the travel path of the side bar subsequent to at least a portion of the bar portion of the side bar being driven into the side face of the concrete slab such that the bar portion is vertically supported by the concrete slab.

33. The method of claim 31 further comprising attaching the frame to the slip form paver.

* * * * *

UNITED STATES PATENT AND TRADEMARK OFFICE

CERTIFICATE OF CORRECTION

PATENT NO. : 6,341,919 B1
DATED : January 29, 2002
INVENTOR(S) : Vincent F. Simpson It is certified that error appears in the above-identified patent and that said Letters Patent is hereby corrected as shown below:

Title page,
Item [73], Assignee, delete the name "Southpac Trust Int'l Inc."
and substitute therefore the name -- CMI Corporation --.

Column 7,
Line 2, delete the word "a".
Line 58, delete the word "a".

Column 8,
Line 31, delete the word "a".

Column 9,
Line 17, delete the word "a"

Signed and Sealed this

First Day of June, 2004

JON W. DUDAS
*Acting Director of the United States Patent and Trademark Office*